United States Patent [19]

Blaha

[11] Patent Number: 4,707,567

[45] Date of Patent: Nov. 17, 1987

[54] SCREW-ON ELECTRICAL CONNECTOR AND METHOD OF MAKING IT

[75] Inventor: William E. Blaha, Elgin, Ill.

[73] Assignee: Ideal Industries, Inc., Sycamore, Ill.

[21] Appl. No.: 874,072

[22] Filed: Jun. 13, 1986

[51] Int. Cl.[4] ..... H01R 4/12

[52] U.S. Cl. ..... 174/87

[58] Field of Search ..... 174/87

[56] References Cited

U.S. PATENT DOCUMENTS

| | | | |
|---|---|---|---|
| 2,110,458 | 3/1938 | Applegate | 174/87 |
| 2,825,750 | 3/1958 | Stockwell | 174/87 |
| 3,097,257 | 7/1963 | Cheney | 174/87 |
| 3,206,833 | 9/1965 | Yonkers | 174/87 |
| 3,297,816 | 1/1967 | Waddington | 174/87 |
| 3,308,229 | 3/1967 | Burniston | 174/87 |
| 3,347,979 | 10/1967 | Hoffman | 174/87 |
| 3,519,707 | 7/1970 | Krup | 264/249 |
| 3,902,005 | 8/1975 | Norden | 174/87 |
| 4,035,577 | 7/1977 | Loeber | 174/84 |
| 4,288,657 | 9/1981 | Swanson | 174/87 |
| 4,531,016 | 7/1985 | Dove | 174/87 |

FOREIGN PATENT DOCUMENTS

| | | | |
|---|---|---|---|
| 365853 | 1/1932 | United Kingdom | 174/87 |

*Primary Examiner*—Morris H. Nimmo

*Attorney, Agent, or Firm*—Kinzer, Plyer, Dorn, McEachran & Jambor

[57] ABSTRACT

This is concerned with a so-called screw-on electrical connector and a method or procedure of making it whereby the manufacturing procedure or process is greatly simplified and the resultant connector is of a quality and efficiency generally at least equal to conventional screw-on connectors.

4 Claims, 4 Drawing Figures

SCREW-ON ELECTRICAL CONNECTOR AND METHOD OF MAKING IT

SUMMARY OF THE INVENTION

This invention is concerned with an electrical connector of the so-called screw-on type which has a plastic insulating cap or shell containing a wire coil or spring which is adapted to be screwed down on the stripped ends of two or more electric wires.

A primary object of the invention is a new connector structure of the screw-on type which is much simpler to make and without any loss in the quality or capability of the connector.

Another object is a method or procedure for making such a connector which provides versatility in the manufacturing process and machine.

Another object is a connector of the above type which is reusable over a greater range.

Another object is a connector of the above type which can be made according to systems, procedures and/or machines which are not dedicated to a specific connector size.

Another object is a method of making a connector of the above type which uses simpler mold parts thereby reducing expense.

Another object is a connector and method of making it which effects substantial savings in raw material.

Another object is a connector and method of making it of the above type which reduces the rate of rejects.

Another object is an electrical connector of the above type which is assembled by induction heating.

Other objects will appear from time to time in the ensuing specification and drawings.

BRIEF DESRIPTION OF THE DRAWINGS

BRIEF DESCRIPTION OF THE PREFERRED EMBODIMENT

Figure 1:
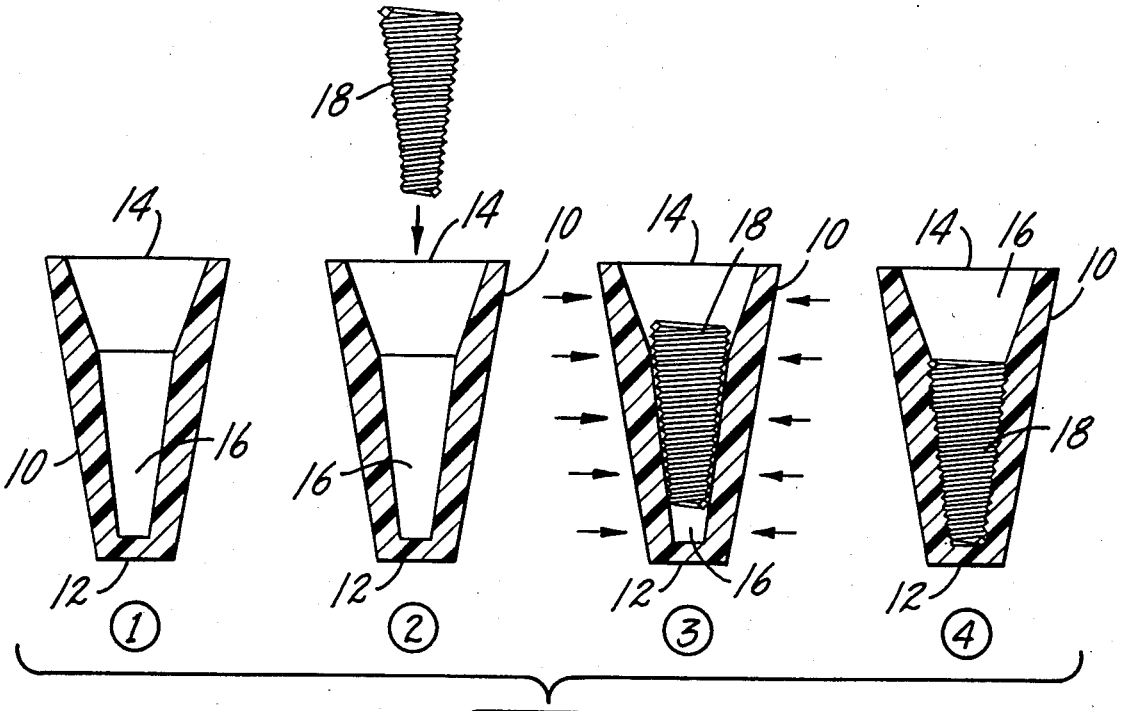
FIG. 1 is a schematic, partly in section, of a number of steps in making the connector.

In FIG. 1, step 1, a connector shell or cap is shown at 10 which is upwardly truncated or tapered with an end wall or closure 12 at the small end and an opening 14 at the large end. The cap is of a conventional type for screw-on connectors and the details thereof are otherwise unimportant. The bore 16 or central cavity is constructed, arranged and dimensioned to accept a coil or wire as explained hereinafter.

In step 2 the cap has been shown as positioned under a coil of wire 18 which is correspondingly tapered and, as indicated by the arrow, is dropped or lowered down into the bore of the cap. Positioning the cap with the open end up and dropping the coil in is the easiest but it might be done the other way around, i.e. the cap raised up to the coil or a combination thereof, or on a side by side basis although the complication in handling equipment makes the procedure shown in step 2 preferable.

In step 3 the coil is resting in the bore and held therein by gravity and the combination is passed through or placed in a heating station, as indicated by the arrows, which preferably takes the form of an induction heating step. This is to say that electromagnetic energy is applied which causes the coil which is metal to heat up but not the plastic. The heating means used referred to as an induction heating arrangement may be any one of a number of forms of radiant energy in the frequency range that will generate or induce heat in the metal coil and may be somewhere between 1,000 megahertz and upward to something on the order of 300,000 megahertz. These extremes are merely given as an example of the general parameters of well known induction heating devices and are not intended to be specific limitations. While the heating step has been referred to as preferably the use of induction heating, it should be understood that other forms or ways of heating the coil may be used. For example ultrasonics may be used to heat the coil. Or, a hot probe in contact with the inside of the coil will be effective. Or, a heating coil in the inside of the coil for a sufficient time will heat the coil sufficiently to cause the plastic in the bore of the shell to flow. So the invention should not be limited to induction heating.

Figure 2:
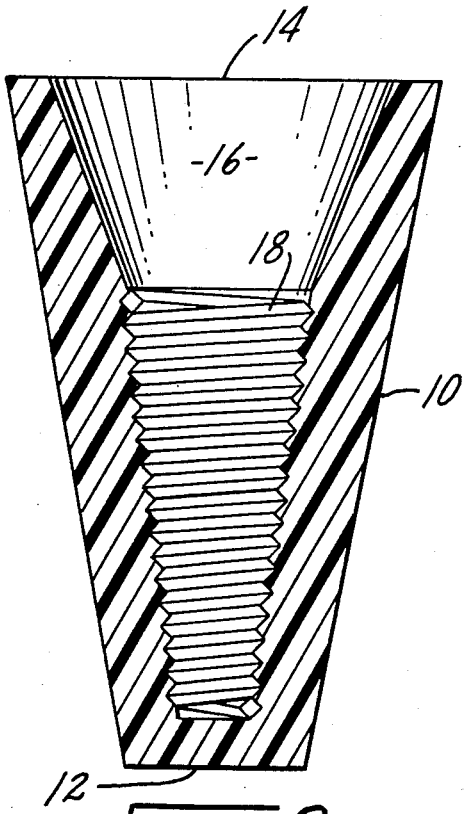
FIG. 2 is an enlargement, partly in section, of the finished connector.
Figure 3:
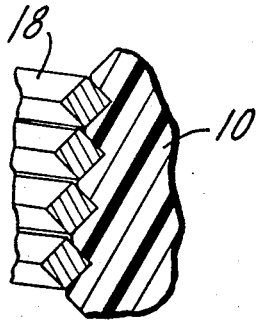
FIG. 3 is an enlargement in cross section of a part of the side wall of FIG. 2.
Figure 4:
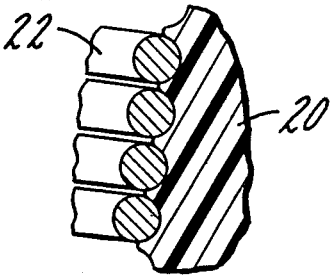
FIG. 4 is an enlargement in cross section of a part of the side wall of a variant form.

After the heating step the cap and coil are removed as a finished connector, as shown in FIG. 4 and are ready for boxing, packaging, shipment, etc. The finished connector of step 4 is shown enlarged in FIG. 2 and more so in FIG. 3. The heat generated in the coil should be such that the plastic in contact with the coil will flow. The inner surface of the cap may be of any suitable form or configuration and, in its simplest form, may be a conventional cone without ribs or any special configuration. The coil is shown as having or made up of wire that has a square cross section and after the coil is placed in the cap, prior to heating, as in step 2 of FIG. 1, the outer point of the coil cross section will bear against the plastic cone. During the heating step the heat generated will cause the coil to heat the plastic causing it to flow which will allow or cause the coil to drop down a little in the cap until the coil becomes firmly embedded in the plastic, as shown by the different positions of the coil in steps 3 and 4 of FIG. 1. The somewhat molten inner surface of the plastic cap will flow into the interstices or spaces between the turns of the coil allowing the outer half, if you will, of each wire turn to become fully embedded in the plastic. Where the turns of the coil are in contact with each other, i.e. a tightly wound coil, the sinking action of the coil as it heats the plastic will cause the outer portion of the turns to displace plastic inwardly into the space or gaps between the turns until as much plastic has flowed inwardly as was displaced from the outside or inner surface of the cap. At this point a state of equilibrium will be reached and the turns of the coil will be fully embedded or adhered to the inner surface of the plastic. The last or largest turn at the top end of the coil will be equally embedded in the plastic which, among other things, will prevent or tend to prevent the coil from coming out of the cap.

The plastic used may be any of the thermoplastics, but it is preferred that nylon, polypropylene and/or polybutylene terephthalate be used or some combination thereof.

The particular wire shown for the coil is what is known as square wire of the type shown generally in U.S. Pat. No. 4,220,811, issued Sept. 2, 1980, but the wire could be round in cross section such as shown in U.S. Pat. No. 3,075,038, issued Jan. 22, 1963, if desired. For example, in FIG. 4, which is similar to FIG. 3, the cross section of the cap is indicated at 20 with the coil at 22 being of round cross section. Also, an oblong or elliptical cross section type wire might be used such as shown in U.S. Pat. No. 3,519,707, issued July 7, 1970.

In the cap shown and described, the interior of the bore where the coil engages it is a single taper, and it should be understood that more than one taper might be used such as in U.S. Pat. No. 2,825,750, issued Mar. 4, 1958. As well, the cap shown in FIGS. 1 through 3 may be assumed to have flutes or grooves on the exterior surface to aid in gripping and turning but it might have levers to assist in turning it, such as shown in U.S. Pat. No. 3,001,002, issued Sept. 19, 1961.

It is common in the art for the coil to be an hour-glass shape which is to say that it proceeds from its open end which is large to a narrow opening or throat and then expands again toward the inner end which is seated in the cap, of the type shown generally in U.S. Pat. No. 3,075,038, issued Jan. 22, 1963. And a coil of that type which is generally known as a "free spring" coil or connector may be used herein. The interior of the cap has been stated to be smooth but it might have a special construction, for example longitudinal ribs on the interior such as shown in U.S. Pat. No. 4,227,040, issued Oct. 7, 1980. And the interlock or adhesion might take place between the ribs and the coil only, or a combination. As well the cross section through the cap may take any suitable form, i.e. an example being that disclosed in U.S. Pat. No. 4,220,811, issued Sept. 2, 1980. It has also been stated that the resulting connector is intended to be screwed down on the stripped ends of a plurality of electric wires. And it should be understood that the connector might be a so-called no strip connector meaning that all of the insulation is not removed from the ends of the For example, in U.S. Pat. No. 3,497,607, issued Feb. 24, 1970, the interior of the coil is of a construction that will cut or abrade through a certain degree of insulation on the wires to be connected. And the present invention could be used in that type of a connector.

The use operation and function of the invention are as follows.

The invention is a screw-on electrical connector and a method of making it. As a result of placing a simple coil inside of a simple cap and securing it therein by induction heating, no special molding equipment is required. The initial form of the cap and the wire coil may be of a quite simple form. Each end of the wire of the coil, the flat faces, will embed themselves sufficiently in the plastic such that when the finished connector is being turned down on the stripped ends of the wires the tip or flat face at the small end will be driven by the rotation of the cap. As well, when the connector is to be removed from the wires by reverse rotation, the tip or flat face at the large end of the wire will be embedded sufficiently in the plastic that it will be driven causing the coil to stay in the cap and the connector may be reused.

The amount, degree and type of induction heating and the time period thereof should be such that a firm adherence is acquired between the exterior of the coil and the interior of the cap or shell but without much if any plastic flowing between the turns of the coil to its inner surface which might well interfere with making a suitable connection. While the turns of the coil have been shown in contact with each other, which is referred to as a closed spring, it may be open or distended somewhat so that the turns are not in contact with each other, such as shown in FIG. 5 of U.S. Pat. No. 3,110,755, issued Nov. 12, 1963. And the present invention should be considered to include such an arrangement.

While it has been stated that the taper or cone of the coil and the inside of the cap more or less match each other, it should be understood that they may be to a degree different such as shown in U.S. Pat. No. 2,825,750, issued Mar. 4, 1958. The particular match or degree of contact between the two prior to heating should be such that a firm and effective interlock or adherence is provided between them.

While the preferred form and several variations of the invention have been shown, described and suggested, it should be understood that suitable additional modifications, changes, substitutions and alterations may be made without departing from the invention's fundamental theme.

I claim:

1. In an electrical connector of the screw-on type for joining the ends of two or more electric wires, a cap of stiffly flexible insulating thermoplastic material having a generally central bore open at one end and closed at the other end by an integral end wall, and a generally tapered wire coil in the bore arranged to receive and be turned down over the stripped ends of a plurality of electric wires, at least a substantial extent of the circumferential exterior of the wire coil adhering to the central bore of the cap, substantially all of the exterior of the coil in contact with the cap being adheringly joined therein to form a substantial circumferential interlock therewith of sufficient strength alone to withstand the rotative forces between the cap and coil when the connector is being tuned down on and removed from the stripped ends of a plurality of electric wires.

2. The structure of claim 1 further characterized in that the wire of the coil has a square cross section.

3. The structure of claim 1 further characterized in that the wire of the coil has a round cross section.

4. The structure of claim 1 further characterized in that the cap is made of polypropylene.

* * * * *

UNITED STATES PATENT AND TRADEMARK OFFICE

CERTIFICATE OF CORRECTION

PATENT NO. : 4,707,567

DATED : Nov. 17, 1987

INVENTOR(S) : William E. Blaha

It is certified that error appears in the above-identified patent and that said Letters Patent is hereby corrected as shown below:

Column 3, line 35, after "the" insert --wires.--.

Signed and Sealed this

Thirteenth Day of June, 1989

*Attest:*

DONALD J. QUIGG

*Attesting Officer*

*Commissioner of Patents and Trademarks*